US006536981B1

(12) United States Patent
Ishola

(10) Patent No.: US 6,536,981 B1
(45) Date of Patent: Mar. 25, 2003

(54) ADJUSTABLE BINDER APPARATUS

(76) Inventor: Ganiyu Ishola, 134-101 Parkside Dr., Port Moody BC (CA), Y3H 4W6

( * ) Notice: Subject to any disclaimer, the term of this patent is extended or adjusted under 35 U.S.C. 154(b) by 0 days.

(21) Appl. No.: 10/028,351

(22) Filed: Dec. 21, 2001

(51) Int. Cl.[7] ..... B42F 3/00
(52) U.S. Cl. ..... 402/60; 402/64; 402/61
(58) Field of Search ..... 402/60, 64, 68, 402/61, 24, 58, 59, 62, 63; 281/21.1, 15.1

(56) References Cited

U.S. PATENT DOCUMENTS 3,412,734 A * 11/1968 Schwartz ..... 402/60
4,136,981 A * 1/1979 Stecklow ..... 402/68
4,813,836 A * 3/1989 Giulie ..... 402/60
5,320,456 A * 6/1994 With ..... 402/60

* cited by examiner

*Primary Examiner*—Willmon Fridie, Jr.
(74) *Attorney, Agent, or Firm*—Kaardal & Leonard, LLP

(57) ABSTRACT

A adjustable binder apparatus for holding papers or other sheet materials together in a manner that does not concentrate pressure on small areas of the paper. The adjustable binder apparatus includes a main member defining a gap for receiving a portion of sheet materials. A pressure assembly is mounted in the gap of the main member, and is slidably movable in the gap for abutting against a portion of sheet materials when the sheet materials are inserted into the gap. The pressure assembly is releasably securable to the central portion of the main member such that spacing between the pressure assembly and one of the side portions of the main member is adjustable.

18 Claims, 5 Drawing Sheets

ADJUSTABLE BINDER APPARATUS

BACKGROUND OF THE INVENTION

1. Field of the Invention

The present invention relates to binders and more particularly pertains to a new adjustable binder apparatus for holding papers or other sheet materials together in a manner that does not concentrate pressure on small areas of the paper.

2. Description of the Prior Art

The use of binders for large groups of papers is generally known in the prior art. Binders of the removable type include clamps that have a channel configuration with sides that are biased together, typically by the spring resiliency of the side walls of the clamp. However, the pinching pressure of the side walls is generally applied to the group of papers along the free edges of the side walls. Further, the intense pinching pressure must be overcome by the fingers of the user in order to open the jaws of the clamp to insert the papers therebetween, and as the thickness of the papers to be bond increases, the pinching pressure that must be overcome greatly increases, and the possibility of the clamp slipping from or flipping out of the grip of the user during the pinching action also greatly increases. The pinching pressure needed to open the jaws of the clamp thus can make the clamps difficult or even impossible to use by persons with little finger strength or arthritis.

In these respects, the adjustable binder apparatus according to the present invention substantially departs from the conventional concepts and designs of the prior art, and in so doing provides an apparatus primarily developed for the purpose of holding papers or other sheet materials together in a manner that does not concentrate pressure on small areas of the paper and that is easier to apply to paper without great finger strength.

SUMMARY OF THE INVENTION

In view of the foregoing disadvantages inherent in the known types of binders now present in the prior art, the present invention provides a new adjustable binder apparatus wherein the same can be utilized for holding papers or other sheet materials together in a manner that does not concentrate pressure on small areas of the paper, and is also easier to apply to even large groupings of paper without requiring the application of a great amount of finger pressure.

To attain this, the present invention generally comprises a main member defining a gap for receiving a portion of sheet materials. A pressure assembly is mounted in the gap of the main member, and is slidably movable in the gap for abutting against a portion of sheet materials when the sheet materials are inserted into the gap. The pressure assembly is releasably securable to the central portion of the main member such that spacing between the pressure assembly and one of the side portions of the main member is adjustable.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
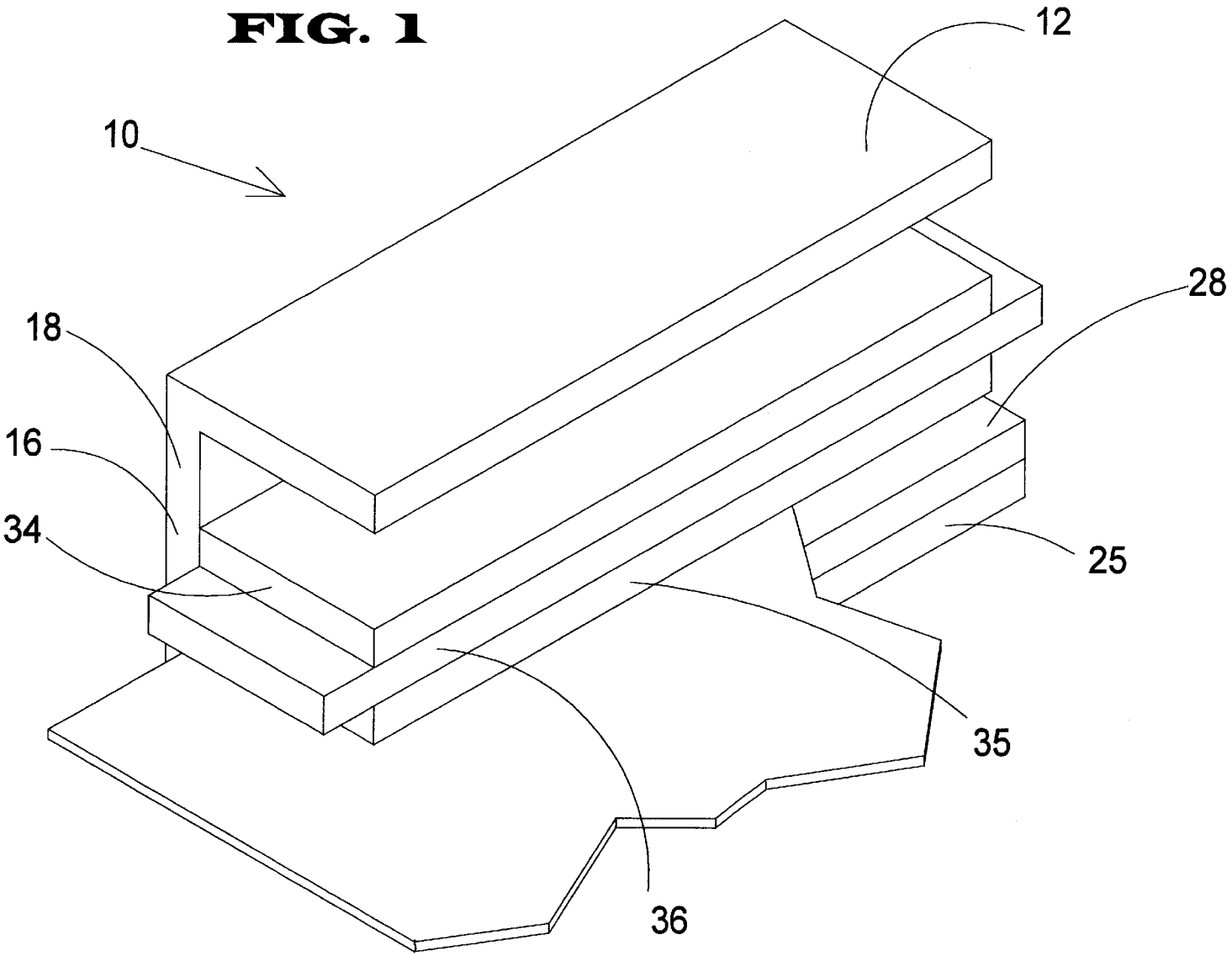
FIG. 1 is a schematic perspective view of a new adjustable binder apparatus according to the present invention.
Figure 2:
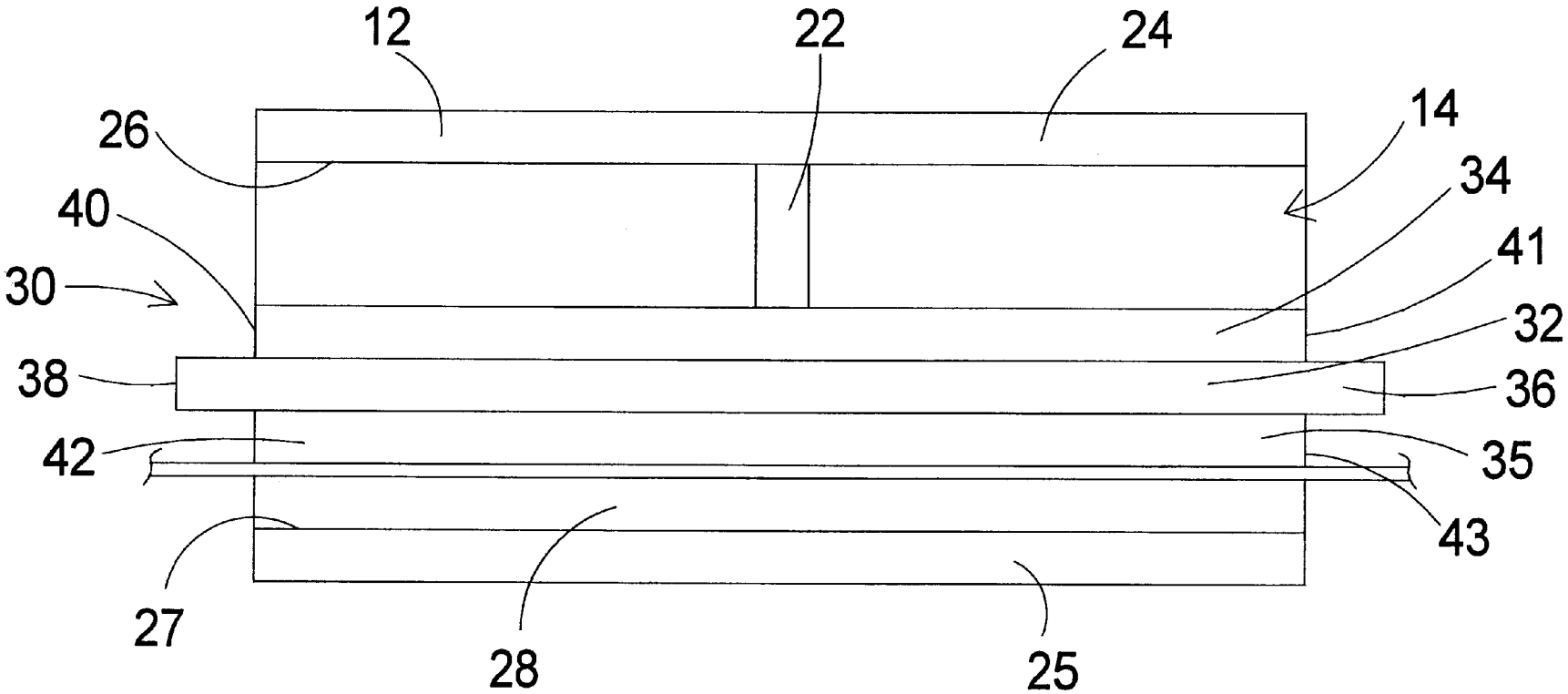
FIG. 2 is a schematic front view of the present invention.
Figure 3:
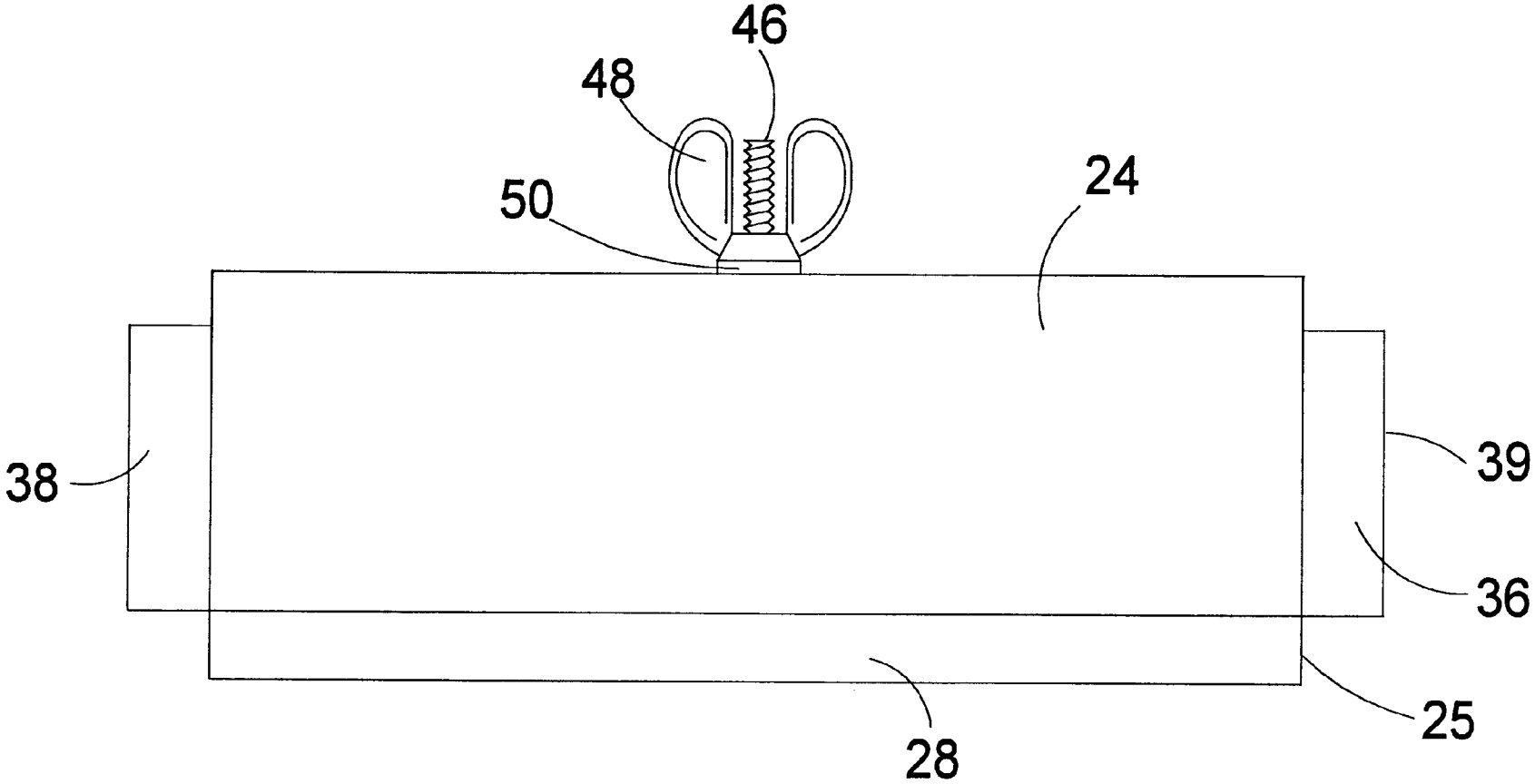
FIG. 3 is a schematic top view of the present invention.
Figure 4:
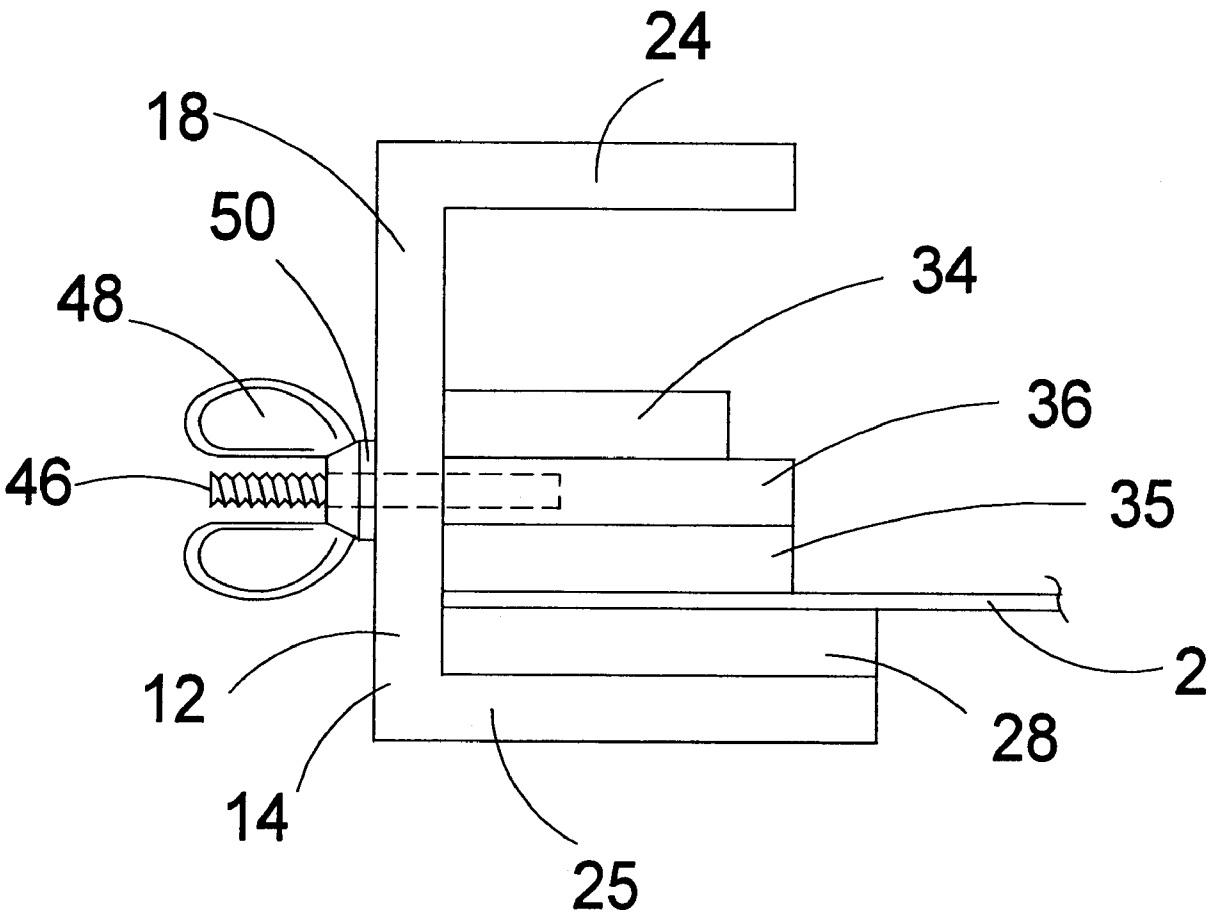
FIG. 4 is a schematic side view of the present invention.
Figure 5:
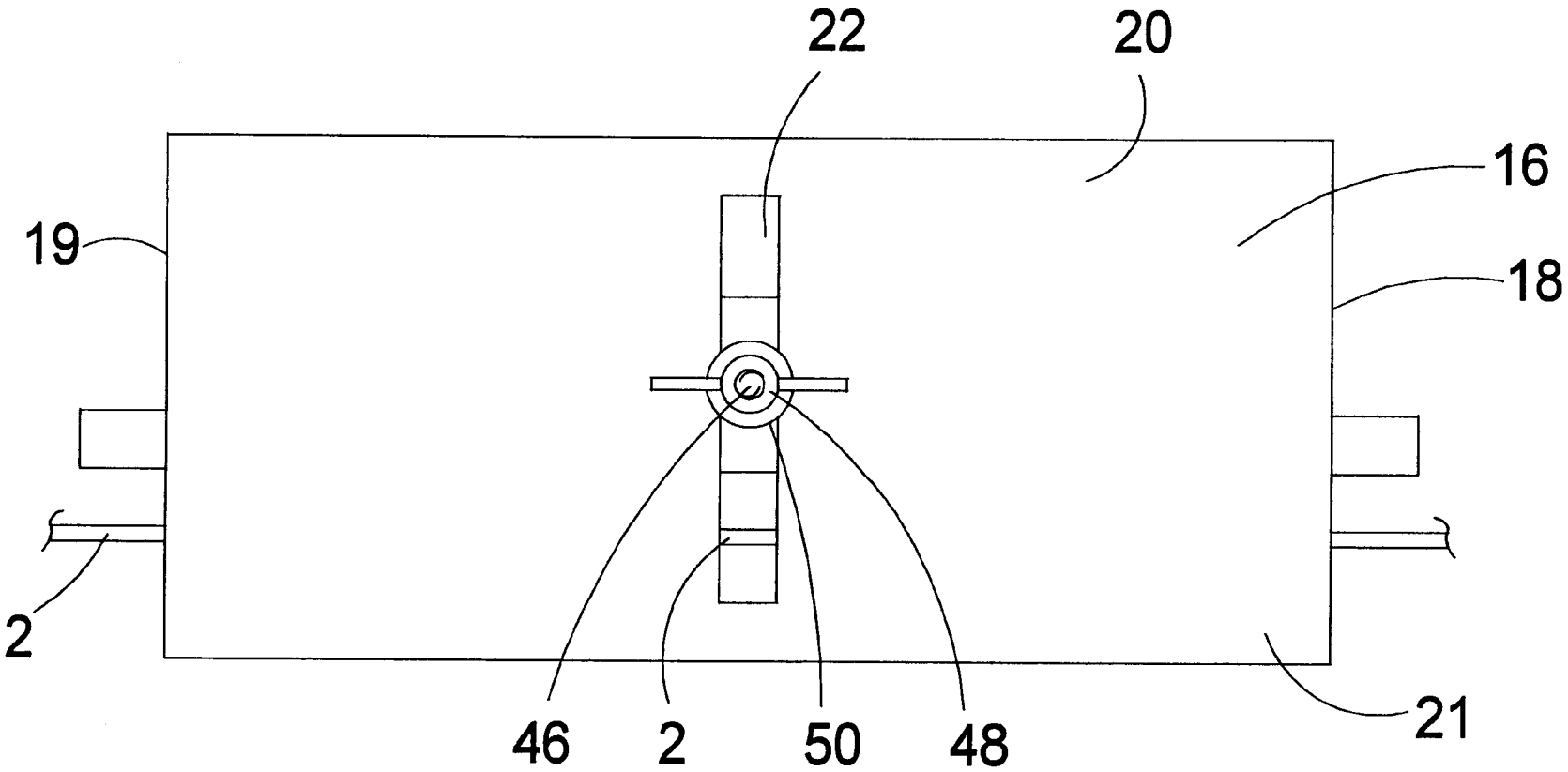
FIG. 5 is a schematic rear view of the present invention.

With reference now to the drawings, and in particular to FIGS. 1 through 5 thereof, a new adjustable binder apparatus embodying the principles and concepts of the present invention and generally designated by the reference numeral 10 will be described.

As best illustrated in FIGS. 1 through 5, the adjustable binder apparatus 10 generally comprises a main member 12 and a pressure assembly 30 mounted on the main member for pressing sheets or panels against the main member to hold the panels or sheets together.

The adjustable binder apparatus 10 of the invention releasably holds sheet materials together. The apparatus 10 may comprise a main member 12 defining a gap 14 for receiving a portion of sheet materials 2. The main member 12 may comprise a central portion 16, which may have a pair of end edges 18, 19 and a pair of side regions 20, 21. An elongate slot 22 may be formed in the central portion 16. The elongate slot 22 may have a longitudinal axis that extends transverse to a length of the central portion, and intersects the side regions 20, 21.

The main member 12 may also include a pair of side portions 24, 25 that are mounted on the central portion 16. The side portions each extend from the central portion. The side portions 24, 25 may extend substantially parallel to each other such that inner faces 26, 27 of the side portions are oriented generally parallel to each other. The side portions 24, 25 may also extend substantially perpendicular to the central portion 16. A first one 24 of the side portions may extend further from the central portion 16 than a second one 25 of the side portions. In one embodiment of the invention, the main member is formed of a substantially rigid material that is relatively strong and highly resistant to bending under pressure. One substantially rigid material may comprise polypropylene plastic.

A cushion 28 may be mounted in the gap 14 on one of the side portions 24, 25. The cushion 28 may be mounted on the inner face 26 of the first one 24 of the side portions. The cushion 28 may comprise a resiliently compressible material, and may comprise a foamed elastomeric material.

The invention may also include a pressure assembly 30 mounted in the gap 14 of the main member 12. The pressure assembly 30 may be slidably movable in the gap 14 for abutting against a portion of sheet materials when the sheet materials are inserted into the gap. The pressure assembly 30 may be releasably securable to the central portion 16 of the main member 12 such that spacing between the pressure assembly and one of the side portions 24, 25 of the main member is adjustable. The pressure assembly 30 may comprise a pressure member 32. The pressure member 32 may be oriented substantially parallel to the side portions 24, 25 of the main member 12. The pressure member 32 may be oriented substantially perpendicular to the central portion 16 of the main member 12.

The pressure member 32 comprises a pair of outer sections 34, 35. A first one 34 of the outer sections may extend laterally from the central portion 16 of the main member a greater distance than a second one 35 of the outer sections. The first outer section 34 may be located closer to the first side portion 24 of the main member than the second outer section 35 is located to the first side portion of the main member. The pressure member 32 may also include an intermediate section 36 that is positioned between the outer sections. The intermediate section 36 may have longitudinal ends 38, 39 that extend beyond longitudinal ends 40, 41, 42, 43 of the outer sections, and may also extend beyond the end edges 18, 19 of the central portion 16 of the main member in a manner that permits the user to press down on these protruding portions, or tabs, to snug the pressure member against a group of papers in the gap while the securing structure is secured in the proper position for holding the group of papers. In one embodiment of the invention, the pressure member is formed of a substantially rigid material that is relatively strong and highly resistant to bending under pressure. One substantially rigid material may comprise polypropylene plastic.

The pressure assembly 30 may include a securing structure 44 for securing the pressure member 32 at a selected location in the gap 14. The securing structure 44 may be mounted on the pressure member 32 and may be releasably adjustably secured to the main member 12. The securing structure 44 may comprise a post 46 mounted on the pressure member 32 and extending through the slot 22 of the central portion 16 of the main member 12. The post 46 may have a threaded surface. The securing structure 44 may include a nut 48 removably mounted on the post 46. The nut 48 may be threadedly mounted on the post 46 such that rotation of the nut advances the nut on the post. The nut 48 may comprise a wing nut having a pair of wings extending outwardly therefrom. The securing structure 44 may also include a washer 50 mounted on the post 46 between the nut 48 and the main member 12. Advancing the nut along the post toward the pressure member acts to tighten the nut against the central portion of the main member and press the pressure member against an inner face of the main member, and secures the pressure member against movement with respect to the main member.

In use, a stack or group of papers or panels may be inserted into the gap in a position between the pressure member and one of the side portions of the main member. The pressure member is moved into pressing abutment against the group of papers, preferably in a manner that compresses the cushion to a degree, and the nut of the securing structure is tightened to secure the position of the pressure member with respect to the main member.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable binder apparatus for holding sheet materials together, the apparatus comprising:

a main member defining a gap for receiving a portion of sheet materials, the main member having a central portion and a pair of side portions extending from the central portion; and a pressure assembly mounted in the gap of the main member, the pressure assembly being slidably movable along the central portion in the gap for abutting against a portion of sheet materials when the sheet materials are inserted into the gap, the pressure assembly being releasably securable to the central portion of the main member such that spacing between the pressure assembly and one of the side portions of the main member is substantially infinitely adjustable.

2. The apparatus of claim 1 wherein the pair of side portions are mounted on the central portion.

3. The apparatus of claim 1 wherein the side portions extend substantially parallel to each other and the side portions extend substantially perpendicular to the central portion.

4. The apparatus of claim 2 wherein a first one of the side portions extends further from the central portion than a second one of the side portions.

5. The apparatus of claim 2 additionally comprising a cushion mounted in the gap on one of the side portions.

6. The apparatus of claim 5 wherein the cushion is mounted on the inner face of the first one of the side portions.

7. The apparatus of claim 2 wherein the pressure assembly comprises:

a pressure member; and a securing structure for securing the pressure member at a selected location in the gap, the securing structure being mounted on the pressure member and being releasably adjustably secured to the main member.

8. The apparatus of claim 7 wherein the pressure member is oriented substantially parallel to the side portions of the main member, the pressure member being oriented substantially perpendicular to the central portion of the main member.

9. The apparatus of claim 7 wherein the pressure member comprises:

a pair of outer sections; and an intermediate section positioned between the outer sections.

10. The apparatus of claim 9 wherein the intermediate section having longitudinal ends extending beyond longitudinal ends of the outer sections.

11. The apparatus of claim 9 wherein the longitudinal ends of the intermediate section extending beyond end edges of a central portion of the main member.

12. The apparatus of claim 9 wherein a first one of the outer sections extending laterally from the central portion a greater distance than a second one of the outer sections.

13. The apparatus of claim 7 wherein the main member includes an elongate slot, and the securing structure comprises:

a threaded post mounted on the pressure member and extending through the slot of the main member; and a nut removably mounted on the post, the nut being threadedly mounted on the post such that rotation of the nut advances the nut on the post.

14. An adjustable binder apparatus for holding sheet materials together, the apparatus comprising:

a main member defining a gap for receiving a portion of sheet materials, the main member comprising:

a central portion, the central portion having a pair of end edges and side regions, an elongate slot being formed in the central portion, the elongate slot having a longitudinal axis extending transverse to a length of the central portion; and a pair of side portions mounted on the central portion, the side portions extending from the central portion, the side portions extending substantially parallel to each other, the side portions extending substantially perpendicular to the central portion, a first one of the side portions extending further from the central portion than a second one of the side portions;

a cushion mounted in the gap on one of the side portions, the cushion comprising a resiliently compressible material, the cushion being mounted on the inner face of the first one of the side portions, the cushion comprising a foamed elastomeric material;

a pressure assembly mounted in the gap of the main member, the pressure assembly being slidably movable in the gap for abutting against a portion of sheet materials when the sheet materials are inserted into the gap, the pressure assembly being releasably securable to the central portion of the main member such that spacing between the pressure assembly and one of the side portions of the main member is adjustable, the pressure assembly comprising:

a pressure member, the pressure member being oriented substantially parallel to the side portions of the main member, the pressure member being oriented substantially perpendicular to the central portion of the main member, the pressure member comprising:

a pair of outer sections, a first one of the outer sections extending laterally from the central portion a greater distance than a second one of the outer sections, the first outer section being located closer to the first side portion of the main member than the second outer section is located to the first side portion of the main member; and an intermediate section positioned between the outer sections, the intermediate section having longitudinal ends extending beyond longitudinal ends of the outer section, the longitudinal ends of the intermediate section extending beyond the end edges of the central portion of the main member; and a securing structure for securing the pressure member at a selected location in the gap, the securing structure being mounted on the pressure member and being releasably adjustably secured to the main member, the securing structure comprising:

a post mounted on the pressure member and extending through the slot of the central portion of the main member, the post having a threaded surface;

a nut removably mounted on the post, the nut being threadedly mounted on the post such that rotation of the nut advances the nut on the post, the nut comprising a wing nut having a pair of wings extending outwardly therefore;

a washer mounted on the post between the nut and the main member.

15. An adjustable binder apparatus for holding sheet materials together, the apparatus comprising:

a main member defining a gap for receiving a portion of sheet materials, the main member having a central portion and at least one side portion extending from the central portion;

a pressure assembly mounted in the gap of the main member, the pressure assembly being slidably movable in the gap for abutting against a portion of sheet materials when the sheet materials are inserted into the gap, the pressure assembly being releasably securable to the central portion of the main member such that spacing between the pressure assembly and one of the side portions of the main member is adjustable; and a cushion mounted in the gap and extending substantially parallel to the at least one side portion, the cushion comprising a resiliently compressible material.

16. The apparatus of claim 15 wherein the cushion is mounted on an inner face of the at least one side portion.

17. The apparatus of claim 15 wherein the pressure assembly comprises:

a pressure member; and a securing structure for securing the pressure member at a selected location in the gap, the securing structure being mounted on the pressure member and being releasably adjustably secured to the main member.

18. An adjustable binder apparatus for holding sheet materials together, the apparatus comprising:

a main member defining a gap for receiving a portion of sheet materials, the main member having a central portion and a pair of side portions extending from the central portion; and a pressure assembly mounted in the gap of the main member, the pressure assembly being slidably movable in the gap for abutting against a portion of sheet materials when the sheet materials are inserted into the gap, the pressure assembly being releasably securable to the central portion of the main member such that spacing between the pressure assembly and one of the side portions of the main member is adjustable;

wherein a first one of the side portions extends further from the central portion than a second one of the side portions.

* * * * *